US009254565B1

(12) United States Patent
Wang

(10) Patent No.: US 9,254,565 B1
(45) Date of Patent: Feb. 9, 2016

(54) TOOLBOX

(71) Applicant: Compass Corporation, Tainan (TW)

(72) Inventor: Tzu-Chien Wang, Tainan (TW)

(73) Assignee: COMPASS CORPORATION, Tainan (TW)

( * ) Notice: Subject to any disclaimer, the term of this patent is extended or adjusted under 35 U.S.C. 154(b) by 0 days.

(21) Appl. No.: 14/522,238

(22) Filed: Oct. 23, 2014

(51) Int. Cl.
*B65D 85/28* (2006.01)
*B25H 3/02* (2006.01)
*B65D 25/10* (2006.01)

(52) U.S. Cl.
CPC . *B25H 3/02* (2013.01); *B65D 25/10* (2013.01)

(58) Field of Classification Search
CPC ..... B25H 3/003; B25H 3/025; B65D 85/28
USPC ..... 206/207, 205, 349, 372–379, 759
See application file for complete search history.

(56) References Cited

U.S. PATENT DOCUMENTS 5,535,882 A * 7/1996 Liu ..... B25H 3/003 206/376
6,050,409 A * 4/2000 Delbeck ..... B25H 3/003 206/375
6,978,890 B2 * 12/2005 Pangerc ..... B25H 3/003 206/349
7,168,559 B2 * 1/2007 Chen ..... B25H 3/003 206/373
7,624,863 B2 * 12/2009 Meng ..... B25H 3/025 206/349
8,186,510 B1 * 5/2012 Chen ..... B25H 3/003 206/373
8,302,771 B2 * 11/2012 Arslan ..... B25H 3/003 206/372
8,899,417 B1 * 12/2014 Chen ..... B25H 3/003 206/372
2012/0211384 A1 * 8/2012 Chen ..... B25H 3/028 206/372

* cited by examiner

*Primary Examiner* — Chun Cheung

(57) ABSTRACT

A toolbox includes a receiving seat having two sidewalls. Each sidewall includes a first guiding groove and a pivot. A pivotal seat receiving tools is received in the receiving seat and includes two sides. Each side of the pivotal seat includes an axle received in one of the first guiding grooves and a pivot coupling portion coupled with one of the pivots. A pressing seat includes two vertical portions respectively mounted to the sidewalls of the receiving seat. Each vertical portion includes a second guiding groove. Each axle is received in one of the second guiding grooves. An elastic element is provided for returning the pressing seat. When the pressing seat is pressed, the second guiding grooves of the pressing seat press against and move the axles along the first guiding grooves, the pivot coupling portions couple with the pivots, and the pivotal seat pivots to an exposed position.

8 Claims, 8 Drawing Sheets

A - A

B - B

TOOLBOX

BACKGROUND OF THE INVENTION

The present invention relates to a toolbox and, more particularly, to a toolbox permitting easy access to tools received in the toolbox and occupying a smaller space.

A type of toolbox generally includes a box body for receiving tools and a top cover directly covering an upper opening of the box body. An end of the top cover is pivotably connected to the box body. A cover body of the top cover prevents the tools from falling out of the box body. When a user is intended to use the tools, the user opens the top cover, takes the tools out, and closes the top cover, which is inconvenient. Furthermore, the toolbox of this type cannot be used in a limited space, because a larger space is occupied when the top cover is opened. The operational inconvenience of occupying a larger space due to opening of the top cover is worse when the toolbox is of a portable type.

U.S. Pat. No. 8,016,108 discloses a tool box including a top cover for covering a housing. The top cover is pivotably connected to the housing by a rotation shaft having a drive gear. A torsion spring is received in the rotation shaft. The housing includes a receiving seat for receiving tool tips. The housing includes a driven gear meshed with the drive gear of the top cover. Thus, when the top cover is opened, the receiving seat is automatically exposed to permit access to the tool tips. Although the receiving seat can be exposed while the top cover is opened, the user still has to open the top cover that will occupy a larger space. As a result, the tool box is still not suitable for a limited space.

BRIEF SUMMARY OF THE INVENTION

An objective of the present invention is to provide a toolbox that can be pressed to permit access to tools received therein, providing operational convenience and occupying a smaller space.

A toolbox according to the present invention includes a receiving seat having two sidewalls, an upper wall, and a lower wall spaced from the upper wall in a vertical direction. The receiving seat is annular and defines a first receiving space. Each of the two sidewalls includes a first guiding groove and a pivot. A pivotal seat is received in the first receiving space and includes a tool receiving portion. The tool receiving portion is adapted for receiving tools. The pivotal seat further includes two sides. Each of the two sides of the pivotal seat includes an axle received in the first guiding groove of one of the two sidewalls of the receiving seat. Each of the two sides of the pivotal seat further includes a pivot coupling portion coupled with the pivot of one of the two sidewalls of the receiving seat. A pressing seat is mounted to an outer side of the receiving seat and is movable relative to the receiving seat in the vertical direction. The pressing seat includes two vertical portions respectively mounted to outer sides of the two sidewalls of the receiving seat. The pressing seat further includes a top portion connected between upper ends of the two vertical portions. Each of the two vertical portions includes a second guiding groove extending in a transverse direction perpendicular to the vertical direction and having a wall face. Each axle of the pivotal seat is received in the second guiding groove of one of the two vertical portions of the pressing seat. An elastic element is provided for returning the pressing seat.

When the pressing seat is not pressed, the pivotal seat is in a storage position received in the first receiving space of the receiving seat.

When the pressing seat is pressed, the wall face of each second guiding groove of the pressing seat presses against and moves one of the axles of the pivotal seat along one of the first guiding grooves, the pivot coupling portions of the pivotal seat couple with the pivots of the receiving seat, and the pivotal seat pivots to an exposed position permitting access to the tools.

In an example, each first guiding groove of the receiving seat inclines downwards. Each first guiding groove includes an upper, vertical, rectilinear section in an intermediate portion of one of the two sidewalls. Each first guiding groove further includes an arcuate section below the upper, vertical, rectilinear section. Each of the two sides of the pivotal seat includes a groove having an opening in a bottom end of the groove. Each pivot of the receiving seat is received in one of the grooves of the pivotal seat. Each pivot coupling portion of the pivotal seat is located in a top end of one of the grooves of the pivotal seat.

Each first guiding groove of the receiving seat 1 can include an end having an opening in communication with the arcuate section. The opening of each first guiding groove permit one of the axles of the receiving seat to be easily inserted into one of the first guiding grooves.

Each of the two sidewalls of the receiving seat 1 can include an outer side having a vertical groove and two vertical ridges on two sides of the vertical groove. Each of the two vertical portions of the pressing seat can have a rail slideably received in one of the vertical grooves of the receiving seat.

The upper wall of the receiving seat can include a positioning plate having an outer side with an engagement member. The top portion of the pressing seat can include a front wall, a rear wall, and a top wall. The front wall, the rear wall, and the top wall define a second receiving space. The top wall includes a positioning groove. The positioning plate is releasably engaged with the positioning groove. The positioning plate disengages from the positioning groove when the pressing seat is not pressed. The positioning plate engages with the positioning groove when the pressing seat is pressed.

The engagement member can include an outer surface having a first slant guiding face. The engagement member can further include a bottom having an engagement edge. The positioning groove of the pressing seat is defined in the top wall and an upper end of the front wall of the pressing seat. The front wall can include an inner face having a second slant guiding face. The second slant guiding face slides along and presses against the first slant guiding face when the pressing seat is pressed. The engagement member extends through the positioning groove. The engagement edge engages with and is positioned at an edge of the positioning groove.

The upper wall of the receiving seat 1 can include a top face having a first attachment portion. The top wall of the pressing seat can include an inner face with a second attachment portion. The elastic element can be a compression spring having two ends respectively attached to the first attachment portion and the second attachment portion.

The pressing seat can further include a guiding portion below each second guiding groove. Each guiding portion can include a recessed portion receiving an end of one of the axles of the pivotal seat. Each guiding portion can further include a partitioning protrusion formed between a top end of the recessed portion and the second guiding groove.

The present invention will become clearer in light of the following detailed description of illustrative embodiments of this invention described in connection with the drawings.

DETAILED DESCRIPTION OF THE INVENTION

Figure 1:
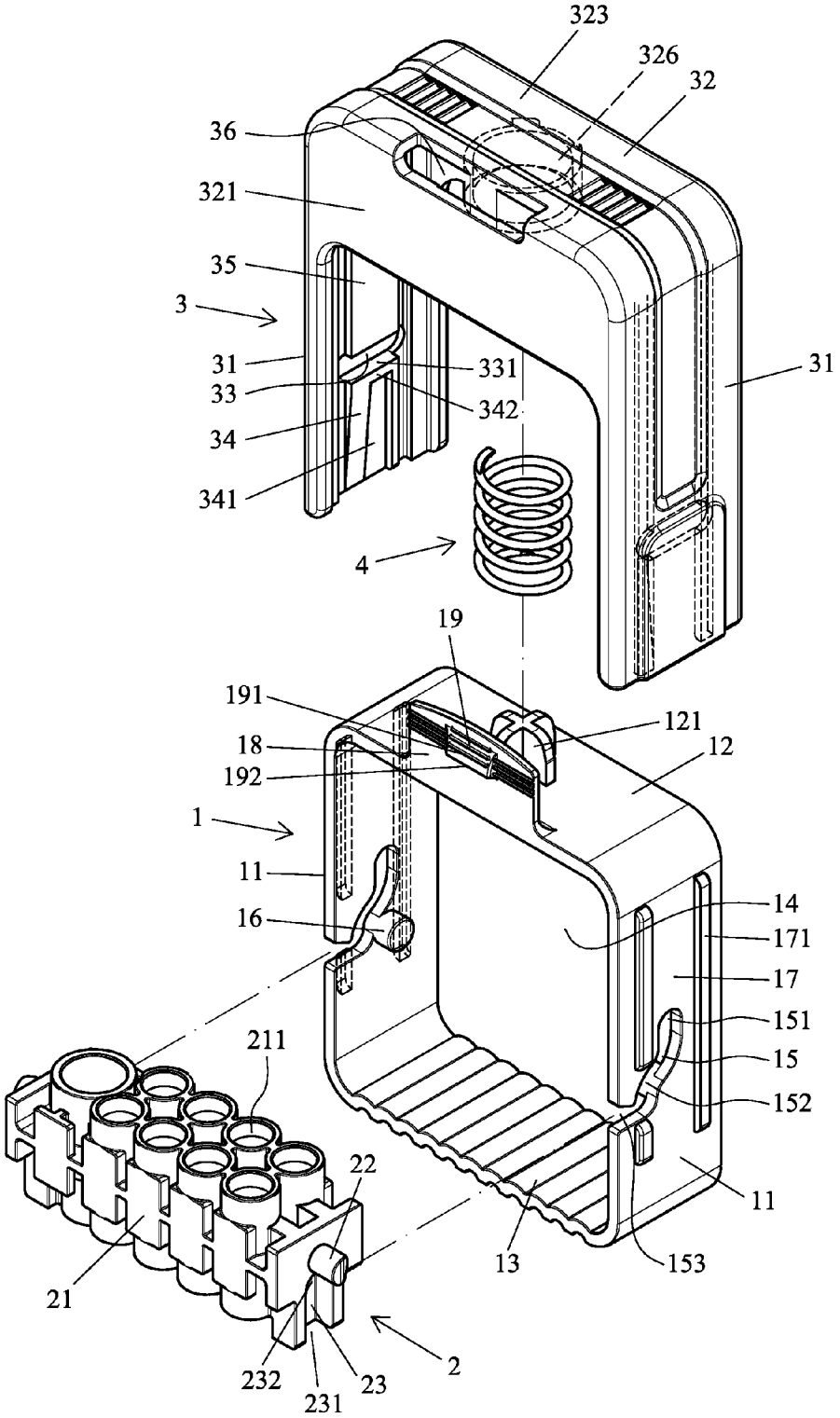
FIG. 1 is an exploded, perspective view of a toolbox according to the present invention.
Figure 2:
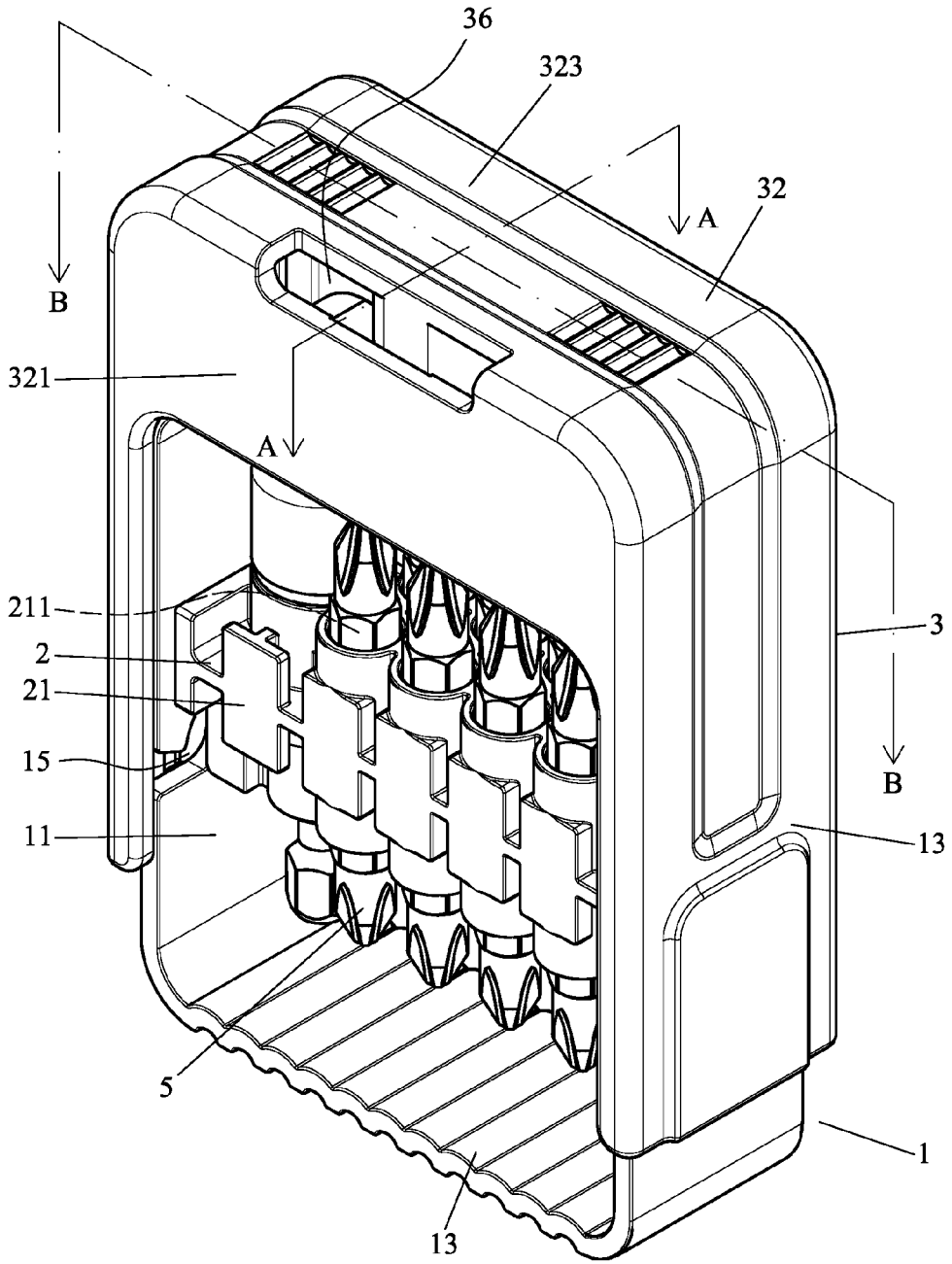
FIG. 2 is a perspective view of the toolbox of FIG. 1.
Figure 3:
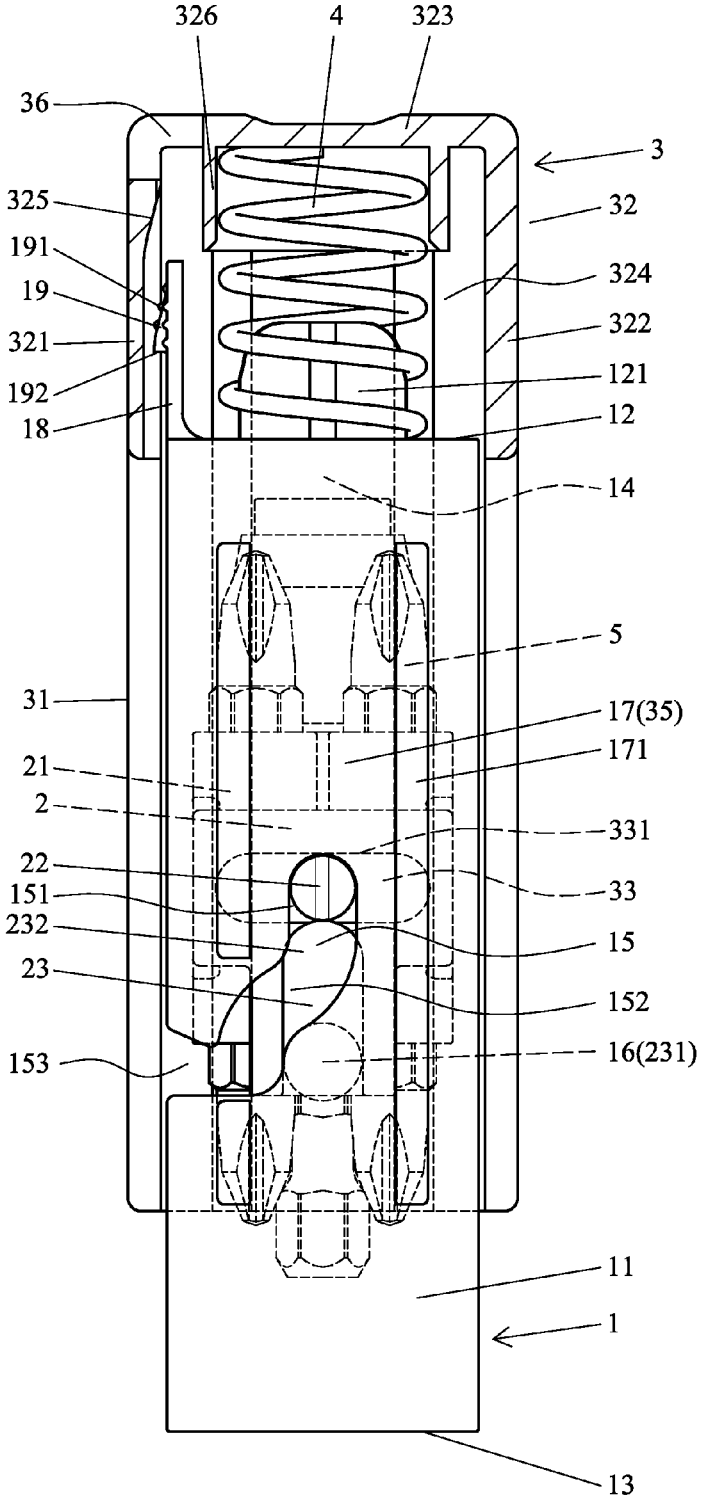
FIG. 3 is a cross sectional view taken along section line A-A of FIG. 2, with a pressing seat not pressed.
Figure 4:
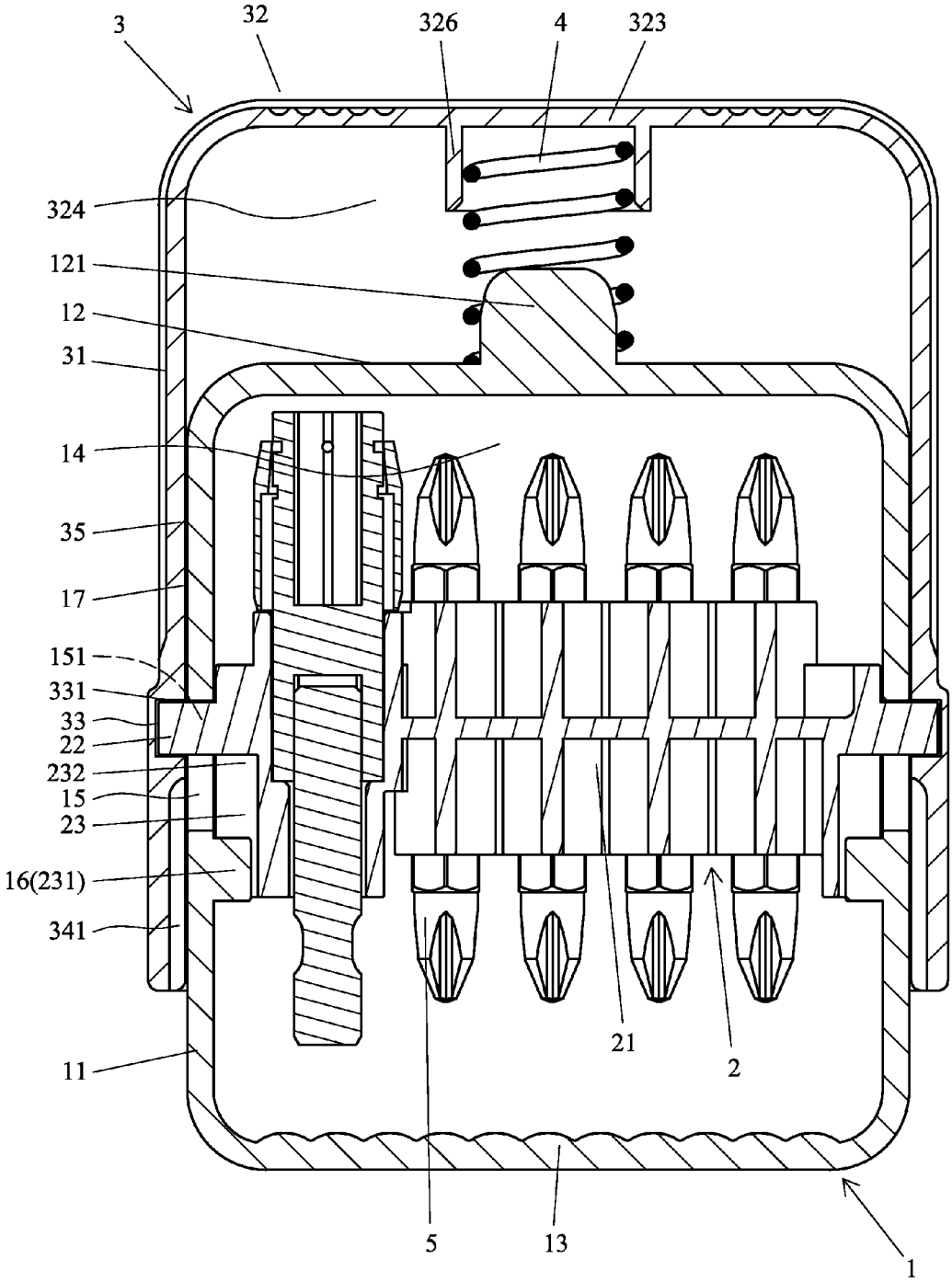
FIG. 4 is a cross sectional view taken along section line B-B of FIG. 2, with the pressing seat not pressed.

With reference to FIGS. 1-4, a toolbox according to the present invention includes a receiving seat 1, a pivotal seat 2, a pressing seat 3, and an elastic element 4. The receiving seat 1 is annular and includes two sidewalls 11 opposite to each other, an upper wall 12, and a lower wall 13 spaced from the upper wall 12 in a vertical direction. The receiving seat 1 includes a first receiving space 14 in a center thereof. Each sidewall 11 includes a first guiding groove 15. In the form shown, each first guiding groove 151 inclines downwards and includes an upper, vertical, rectilinear section 151 in an intermediate portion of one of the sidewalls 11 and an arcuate section 152 below the upper, vertical, rectilinear section 151. Furthermore, each first guiding groove 15 includes an end having an opening 153 in communication with the arcuate section 152. Each sidewall 11 further includes a pivot 16 on an inner surface thereof. Each sidewall 11 further includes an outer side having a vertical groove 17 and two vertical ridges 171 on two sides of the vertical groove 17. The upper wall 12 includes a positioning plate 18 having an outer side with an engagement member 19. The engagement member 19 includes an outer surface having a first slant guiding face 191. The engagement member 19 further includes a bottom having an engagement edge 192. The upper wall 12 further includes a top face having a first attachment portion 121.

The pivotal seat 2 is received in the first receiving space 14 and includes a tool receiving portion 21 adapted for receiving tools 5. The tool receiving portion 21 includes a plurality of coupling holes 211 for receiving tools 5. Each of two sides of the pivotal seat 2 includes an axle 22 insertable into the first guiding groove 15 of one of the sidewalls 11 of the receiving seat 1. The opening 153 of each first guiding groove 15 permits one of the axles 22 of the receiving seat 2 to be easily inserted into one of the first guiding grooves 15. Each side of the pivotal seat 2 further includes a groove 23 having an opening 231 in a bottom end of the groove 23. Each pivot 16 of the receiving seat 1 is received in one of the grooves 23 of the pivotal seat 2. Each groove 23 of the pivotal seat 2 includes a top end having a pivot coupling portion 232 for coupling with one of the pivots 16.

The pressing seat 3 is mounted to an outer side of the receiving seat 1 and is movable relative to the receiving seat 1 in the vertical direction. The pressing seat 3 includes two vertical portions 31 respectively mounted to outer sides of the two sidewalls 11 of the receiving seat 1. The pressing seat 3 further includes a top portion 32 connected between upper ends of the two vertical portions 31. Each vertical portion 31 includes a second guiding groove 33 extending in a transverse direction perpendicular to the vertical direction and having a wall face 331. Each axle 22 of the pivotal seat 2 is received in the second guiding groove 33 of one of the two vertical portions 31 of the pressing seat 3.

The pressing seat 3 further includes a guiding portion 34 below each second guiding groove 33 to permit easy assembly. Each guiding portion 34 includes a recessed portion 341 receiving an end of one of the axles 22 of the pivotal seat 2. Each guiding portion 34 further includes a partitioning protrusion 342 formed between a top end of the recessed portion 341 and the second guiding groove 33 above the guiding portion 34. Each vertical portion 31 of the pressing seat 3 further includes a rail 35 slideably received in one of the vertical grooves 17 of the receiving seat 1.

The top portion 32 of the pressing seat 3 includes a front wall 321, a rear wall 322, and a top wall 323. The front wall 321, the rear wall 322, and the top wall 323 define a second receiving space 324. The top wall 323 includes a positioning groove 36 for releasably engaging with the positioning plate 18 of the receiving seat 1. The positioning groove 36 of the pressing seat 3 is defined in the top wall 323 and an upper end of the front wall 321 of the pressing seat 3. The front wall 321 includes an inner face having a second slant guiding face 325. The top wall 321 further includes an inner face having a second attachment portion 326.

An elastic element 4 is mounted between the receiving seat 1 and the pressing seat 3 for returning the pressing seat 3. In the form shown, the elastic element 4 is a compression spring and has two ends respectively attached to the first attachment portion 121 and the second attachment portion 326.

In assembly, the axles 22 of the pivotal seat 2 are inserted via the openings 153 into the first guiding grooves 15 of the receiving seat 1. An end of the elastic element 4 is attached to the first attachment portion 121 of the upper wall 12 of the receiving seat 1. Then, the pressing seat 3 is mounted on top of the receiving seat 1, with the recessed portions 341 of the guiding portions 34 of the pressing seat 3 aligned with the axles 22. Next, the second guiding grooves 33 of the pressing seat 3 engage with the axles 22 of the pivotal seat 2 by using the flexibility of the vertical portions 31, with the other end of elastic element 4 attached to the second attachment portion 326 and with the elastic element 4 biasing the pressing member 3 to an unpressed position. The openings 231 of the grooves 23 of the pivotal seat 2 are aligned with the pivots 16 of the receiving seat 1. The receiving seat 2 is in a storage position in which the tool receiving portion 21 receiving the tools 5 is in the first receiving space 14 of the receiving seat 1. Furthermore, the coupling holes 211 are in the vertical direction to avoid falling of the tools 5.

Figure 5:
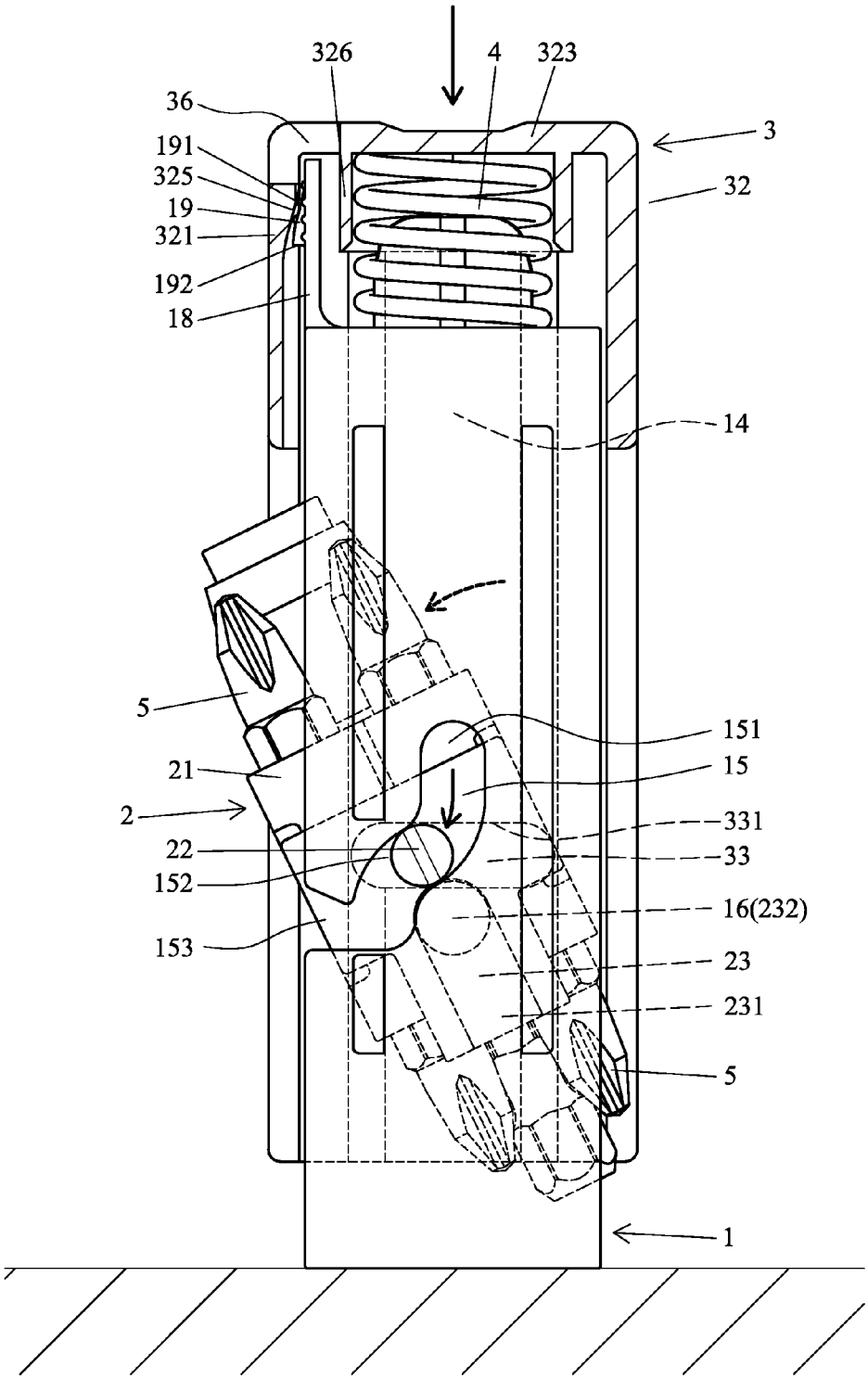
FIG. 5 is a view similar to FIG. 3, with the pressing seat pressed and with a pivotal seat pivoted through an angle smaller than 90°.

With reference to FIG. 5, if a user is intended to use the tools 5, the user presses the pressing seat 3. The wall face 331 of each second guiding groove 33 of the pressing seat 3 presses against one of the axles 22 of the pivotal seat 2 to move the axle 22 downward along the upper, vertical, rectilinear section 151 of one of the first guiding grooves 15. Furthermore, the pivot coupling portions 232 of the pivotal seat 2 press against the pivots 16 of the receiving seat 1. The rails 35 of the pressing seat 3 move downward along the vertical grooves 17 of the receiving seat 1 to provide stable movement.

When the pressing seat 3 is further pressed, the axles 22 move along the arcuate sections 152 of the first guiding grooves 15 and pivot, such that the pivot seat 2 pivots about a pivot axis defined by the pivots 16 of the receiving seat 1. Thus, the pivotal seat 2 pivots to an exposed position permitting access to the tools 5. When the pivotal seat 2 pivots, the second guiding grooves 33 extending in the transverse direction permit the axles 22 to move in the transverse direction relative to the pressing seat 3. Thus, the tools 5 can be accessed when the pivotal seat 2 has pivoted through an angle smaller than 90°, as shown in FIG. 5.

Figure 6:
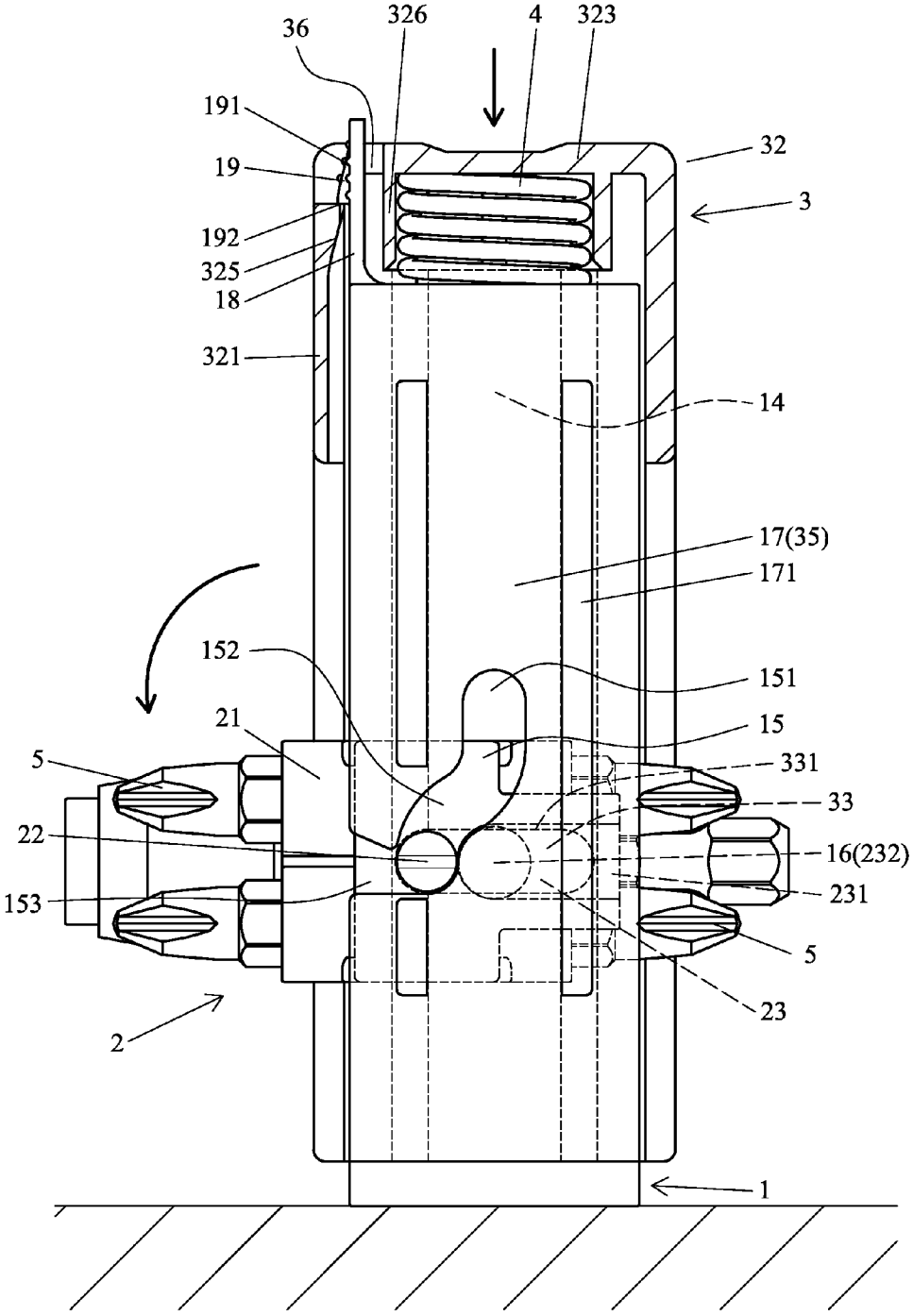
FIG. 6 is a view similar to FIG. 3, with the pivotal seat pivoted through 90° and positioned.
Figure 7:
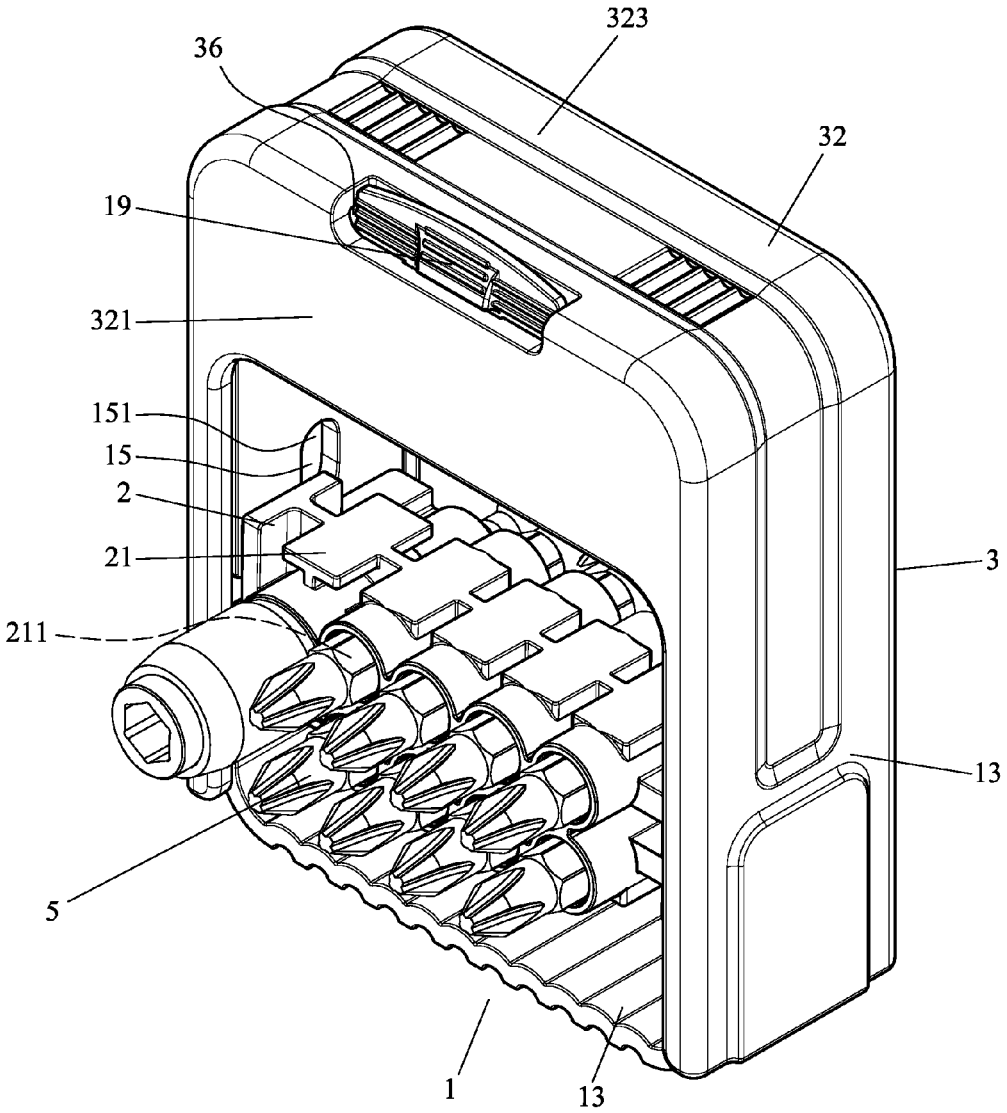
FIG. 7 is a perspective view of the toolbox, with the pivotal seat pivoted through 90°.

With reference to FIGS. 6 and 7, when the axles 22 of the pivotal seat 2 are moved to a position below the arcuate sections 152 of the first guiding grooves 15 by pressing the pressing seat 3 downward, the pivotal seat 2 pivots 90°, and the first slant guiding face 191 of the engagement member 19 presses against the second slant guiding face 325 of the pressing seat 3 such that engagement member 19 extends through the positioning groove 36. The engagement edge 192 engages with and is positioned at an edge of the positioning groove 36. Then, the pressing seat 3 is released, and the pivotal seat 2 retains in the exposed position permitting access to the tools 5.

Figure 8:
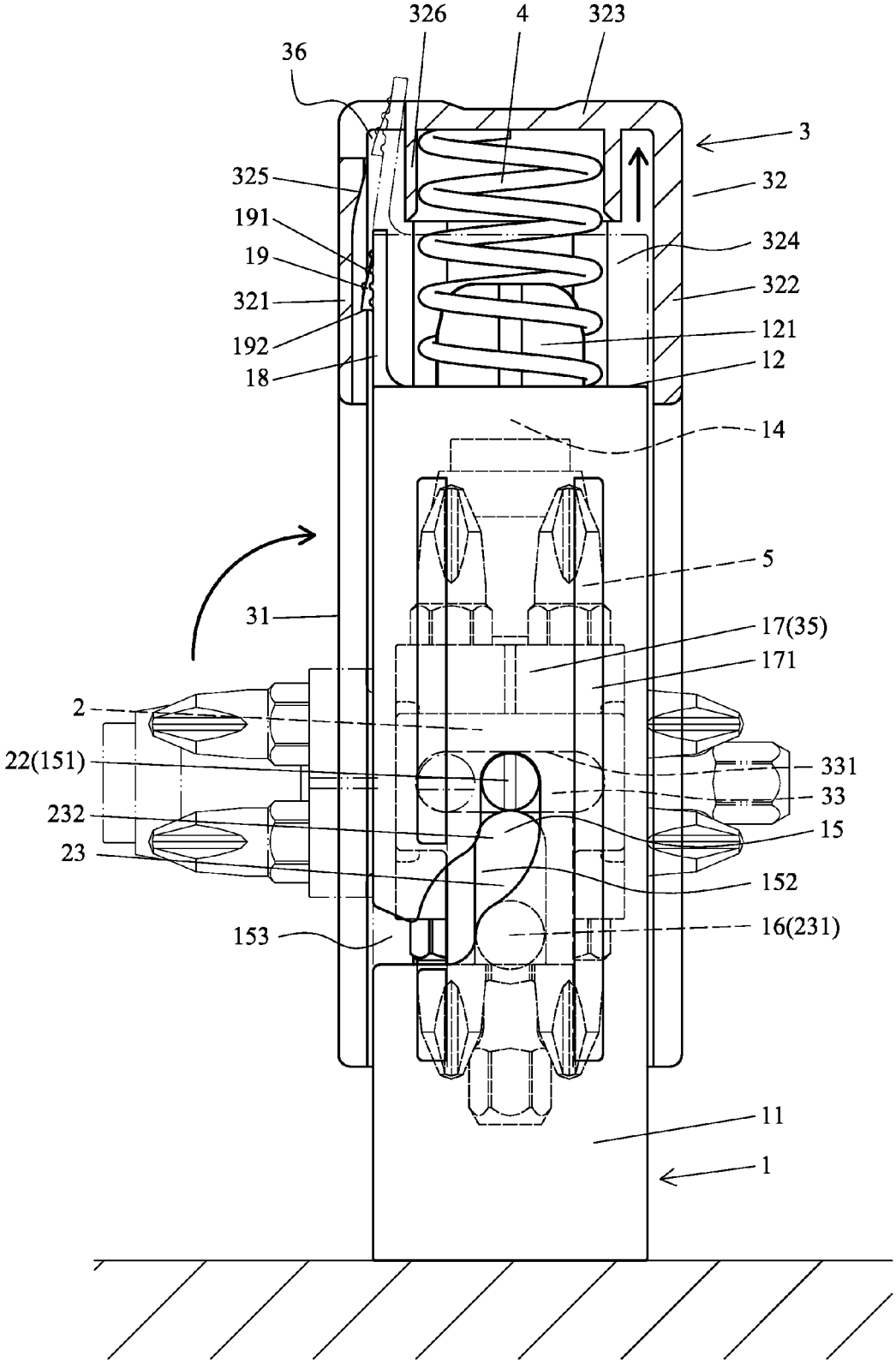
FIG. 8 is a view similar to FIG. 6, with a pressing plate pressed to return the pivotal seat.

With reference to FIG. 8, if it is desired to close the toolbox, the positioning plate 18 extending beyond the positioning seat 36 can be pressed to disengage the engagement member 19 from the positioning groove 36. The pressing seat 3 is moved upward by the elastic force of the elastic element 4, and the axles 22 of the pivotal seat 2 move upward along the first guiding grooves 15, causing the tool receiving portion 21 and the tools 5 to move into the first receiving space 14 of the receiving seat 1. Thus, the toolbox according to the present invention is easier to operate and occupies a smaller space.

In view of the foregoing, the toolbox according to the present invention is easy to operate and solves the disadvantage of occupation of a larger space of conventional toolboxes. It can be appreciated that the pivotal seat 2 can be fixed in a position other than the 90° position. Furthermore, the pivotal seat 2 can include different tool receiving portions 21 for receiving various tools 5.

Although specific embodiments have been illustrated and described, numerous modifications and variations are still possible without departing from the scope of the invention. The scope of the invention is limited by the accompanying claims.

The invention claimed is:

1. A toolbox comprising:

a receiving seat including two sidewalls, an upper wall, and a lower wall spaced from the upper wall in a vertical direction, with the receiving seat being annular and defining a first receiving space, with each of the two sidewalls including a first guiding groove and a pivot;

a pivotal seat received in the first receiving space and including a tool receiving portion, with the tool receiving portion adapted for receiving tools, with the pivotal seat further including two sides, with each of the two sides of the pivotal seat including an axle received in the first guiding groove of one of the two sidewalls of the receiving seat, with each of the two sides of the pivotal seat further including a pivot coupling portion coupled with the pivot of one of the two sidewalls of the receiving seat;

a pressing seat mounted to an outer side of the receiving seat and movable relative to the receiving seat in the vertical direction, with the pressing seat including two vertical portions respectively mounted to outer sides of the two sidewalls of the receiving seat, with the pressing seat further including a top portion connected between upper ends of the two vertical portions, with each of the two vertical portions including a second guiding groove extending in a transverse direction perpendicular to the vertical direction and having a wall face, with each axle of the pivotal seat received in the second guiding groove of one of the two vertical portions of the pressing seat; and an elastic element for returning the pressing seat, wherein when the pressing seat is not pressed, the pivotal seat is in a storage position received in the first receiving space of the receiving seat, and wherein when the pressing seat is pressed, the wall face of each second guiding groove of the pressing seat presses against and moves one of the axles of the pivotal seat to move along one of the first guiding grooves, the pivot coupling portions of the pivotal seat couple with the pivots of the receiving seat, and the pivotal seat pivots to an exposed position permitting access to the tools.

2. The toolbox as claimed in claim 1, with the each first guiding groove of the receiving seat inclining downwards, with each first guiding groove including an upper, vertical, rectilinear section in an intermediate portion of one of the two sidewalls, with each first guiding groove further including an arcuate section below the upper, vertical, rectilinear section, with each of the two sides of the pivotal seat including a groove having an opening in a bottom end of the groove, with each pivot of the receiving seat received in one of the grooves of the pivotal seat, and with each pivot coupling portion of the pivotal seat located in a top end of one of the grooves of the pivotal seat.

3. The toolbox as claimed in claim 2, with each first guiding groove of the receiving seat including an end having an opening in communication with the arcuate section, and with the opening of each first guiding groove permitting one of the axles of the receiving seat to be easily inserted into one of the first guiding grooves.

4. The toolbox as claimed in claim 2, with each of the two sidewalls of the receiving seat including an outer side having a vertical groove and two vertical ridges on two sides of the vertical groove, and with each of the two vertical portions of the pressing seat having a rail slideably received in one of the vertical grooves of the receiving seat.

5. The toolbox as claimed in claim 2, with the upper wall of the receiving seat including a positioning plate, with the positioning plate including an outer side having an engagement member, with the top portion of the pressing seat including a front wall, a rear wall, and a top wall, with the front wall, the rear wall, and the top wall defining a second receiving space, with the top wall including a positioning groove, and with the positioning plate releasably engaged with the positioning groove, wherein the positioning plate disengages from the positioning groove when the pressing seat is not pressed, and wherein the positioning plate engages with the positioning groove when the pressing seat is pressed.

6. The toolbox as claimed in claim 5, with the engagement member including an outer surface having a first slant guiding face, with the engagement member further including a bottom having an engagement edge, with the positioning groove of the pressing seat defined in the top wall and an upper end of the front wall of the pressing seat, with the front wall including an inner face having a second slant guiding face, and with the second slant guiding face sliding along and pressing against the first slant guiding face when the pressing seat is pressed, with the engagement member extending through the positioning groove, and with the engagement edge engaged with and positioned at an edge of the positioning groove.

7. The toolbox as claimed in claim 5, with the upper wall of the receiving seat, including a top face having a first attachment portion, with the top wall of the pressing seat including an inner face with a second attachment portion, and with the elastic element being a compression spring and having two ends respectively attached to the first attachment portion and the second attachment portion.

8. The toolbox as claimed in claim 1, with the pressing seat further including a guiding portion below each second guiding groove, with each guiding portion including a recessed portion receiving an end of one of the axles of the pivotal seat, and with each guiding portion further including a partitioning protrusion formed between a top end of the recessed portion and the second guiding groove.

* * * * *